US012150568B2

(12) United States Patent
Darsan

(10) Patent No.: US 12,150,568 B2
(45) Date of Patent: Nov. 26, 2024

(54) STORAGE DEVICE, ORGANIZER, DISPLAY UNIT

(71) Applicant: Junior Darsan, Humble, TX (US)

(72) Inventor: Junior Darsan, Humble, TX (US)

( * ) Notice: Subject to any disclaimer, the term of this patent is extended or adjusted under 35 U.S.C. 154(b) by 59 days.

(21) Appl. No.: 18/334,023

(22) Filed: Jun. 13, 2023

(65) Prior Publication Data

US 2024/0016317 A1 Jan. 18, 2024

Related U.S. Application Data

(60) Provisional application No. 63/368,462, filed on Jul. 14, 2022.

(51) Int. Cl.

| | |
|---|---|
| ***A47F 7/02*** | (2006.01) |
| ***A47F 5/01*** | (2006.01) |
| ***A47F 5/14*** | (2006.01) |

(52) U.S. Cl.

CPC ..... *A47F 7/022* (2013.01); *A47F 5/01* (2013.01); *A47F 5/14* (2013.01)

(58) Field of Classification Search

CPC .. A47F 5/04; A47F 7/024; A47F 7/022; A47F 5/01; A47F 5/14; A47F 5/0006; A47F 7/02

USPC ..... 211/85.3, 85.2; 206/6.1

See application file for complete search history.

(56) References Cited

U.S. PATENT DOCUMENTS

| | | | |
|---|---|---|---|
| 4,390,099 | A | 6/1983 | Trautlein et al. |
| 5,242,048 | A | 9/1993 | Ellingsworth et al. |
| 7,891,506 | B2 | 2/2011 | Kornowski |
| 9,392,889 | B2 | 7/2016 | Trainor-Smith et al. |
| 10,092,116 | B1 | 10/2018 | Johns et al. |
| 10,206,523 | B2 | 2/2019 | Abebe |
| 2009/0127138 | A1 | 5/2009 | Allameh |

*Primary Examiner* — Chun Hoi Cheung

(57) ABSTRACT

The jewelry display stand is a device intended to provide a convenient way to store and organize a large number of continuous items, including but not limited to jewelry. To accomplish this, the device includes a pair of loops that are oval in shape. Each loop is mounted to a pillar, and each pillar is mounted to a base. Each loop has a spring-pivot door mounted to the front opening. The spring-pivot door is used as an entry way for the securement and placement of jewelry items. The door pivots on one end of the opening via a spring, while the free end of the door magnetically secures to the other end with a pair of magnets. To insert a jewelry item, the user simply applies force against the door, which disengages the magnets and allows the door to open. After insertion, the door automatically closes and locks in place.

20 Claims, 17 Drawing Sheets

STORAGE DEVICE, ORGANIZER, DISPLAY UNIT

FIELD OF THE INVENTION

The present invention relates to jewelry display storages. More specifically, the present invention is a storage and display apparatus for a large number of continuous items including but not limited to jewelry.

BACKGROUND OF THE INVENTION

Jewelry has gradually caught the attention of many people when it comes to fashion and clothing. There are countless varieties of different accessories and/or jewelry items which a person may own. The more invested a person is, the more likely the person will own a plurality of accessories and/or jewelry items. Ownership of a plurality of different accessories and jewelry items will require a storage device. In addition, a storage device that will ideally display and present the plurality of accessories and jewelry items to allow for easy observation and access.

An objective of the present invention is to provide a storage device for a plurality of accessories and jewelry items. The present invention provides a device used to store and hold a plurality of accessories and/or jewelry items. In addition, the present invention provides a display device that presents and show all of the stored and secured accessories and/or jewelry items.

SUMMARY

It is an aim of the present invention to provide a convenient way to store and organize a large number of continuous items of jewelry such as bracelets, bangles, watches, necklaces, earrings, rings and the like, so that said items can be organized and held in specific relative locations. The present invention is a jewelry organizer stand comprising a base, a first pillar, a second pillar, a first loop, and a second loop. Each of the pillars are spaced apart from each other and mounted to the base. The first loop is mounted to the top of the first pillar, and the second loop is mounted to the top of the second pillar.

Each loop is oval-shaped, designed to hold and secure accessories and/or jewelry items. In addition, each loop further comprises a spring-pivot door mounted to a front opening. The spring-pivot door is used as an entry way for the securement and placement of said accessories and/or jewelry items. The spring-pivot door pivots on one side of the front opening, via a spring. In particular, one end of the spring is attached to one side of the front opening, while the other end of the spring is attached to the pivoting end of the spring-pivot door. Thus, the spring-pivot door is capable of opening in any direction where force is applied.

To secure the spring-pivot door closed, each loop further comprises a pair of magnets. Specifically, one of the magnets is embedded into the opposite side of the front opening, while the second magnet is embedded into the free end of the spring-pivot door. This allows the spring-pivot door to automatically close without the need to manually close said door or the need for a locking device. When the door is not pushed or pulled, the spring is relaxed to its normal straight orientation which closes the front opening of the loop.

In another embodiment, each loop comprises a pair of spring-pivot doors that pivot on each end and open along the center of the front opening. In this embodiment, each spring-pivot door is mounted to one side of the front opening, via a spring. Each free end of the pair of spring-pivot doors are facing each other at the center of the front opening. At the center of the front opening, a pair of magnets are embedded within the free ends of the spring-pivot doors. This enables the spring-pivot doors to automatically close when both springs are relaxed in a normal straight position.

In another embodiment, the present invention comprises a first loop that can attach to any mounting structure including, but not limited to a desk stand, a wall plate, a mirror using suction cups, or a slat-wall bracket.

DETAIL DESCRIPTIONS OF THE INVENTION

Figure 1:
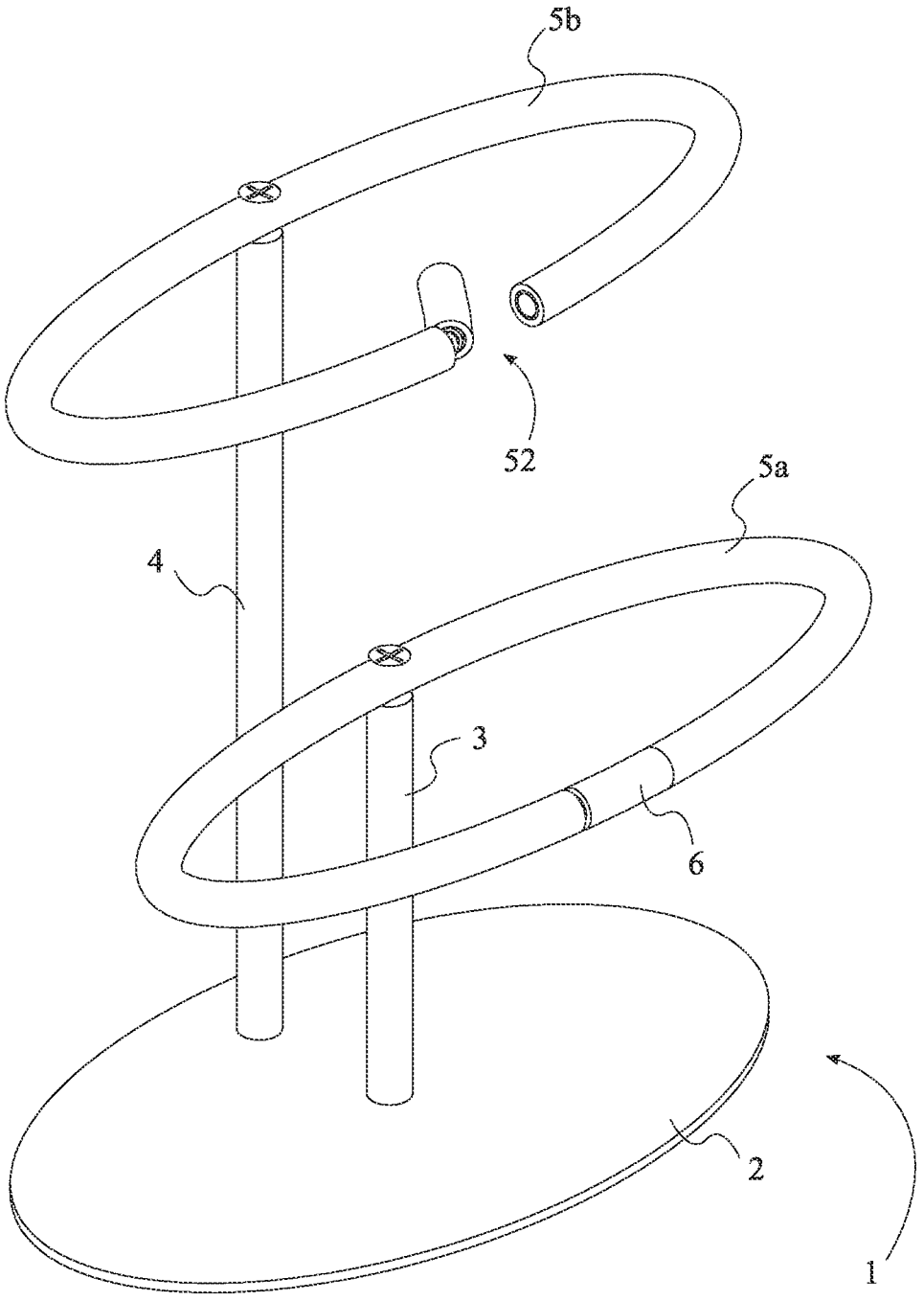
FIG. 1 is a top-front perspective view of the present invention.

All illustrations of the drawings are for the purpose of describing selected versions of the present invention and are not intended to limit the scope of the present invention.

In reference to FIG. 1 through FIG. 21, the present invention is a jewelry organizer stand 1. It is an aim of the present invention to provide a convenient way to store and organize a large number of continuous items of jewelry such as bracelets, bangles, watches, necklaces, earrings, rings and the like, so that said items can be organized and held in specific relative locations. More specifically, the user can attach individual jewelry items to a first loop 5*a* and a second loop 5*b*. Each loop is mounted to a pillar and each pillar is mounted to a base 2. For improved handling and display of the jewelry items, the pillars 3 and 4 are of different heights and spaced apart from each other on the base 2. The user can insert or retrieve items to and from each loop through a spring-pivot door 6 at the front opening 52. The door pivots on one end of the opening via a spring 7, while the free end of the door magnetically secures to the other end of the opening with a pair of magnets 8. To insert a jewelry item, the user simply applies force against the door, which in turn, causes the pair of magnets 8 to disengage and allow the door to open. Because the door is mounted to a spring and secured with magnets, the door automatically closes without the need to manually close the door or the need for a locking device. Thus, when the door is not pushed or pulled, the spring is relaxed to its normal straight orientation which closes the front opening of the loop and prevents stored items from falling off the storage loop.

Figure 2:
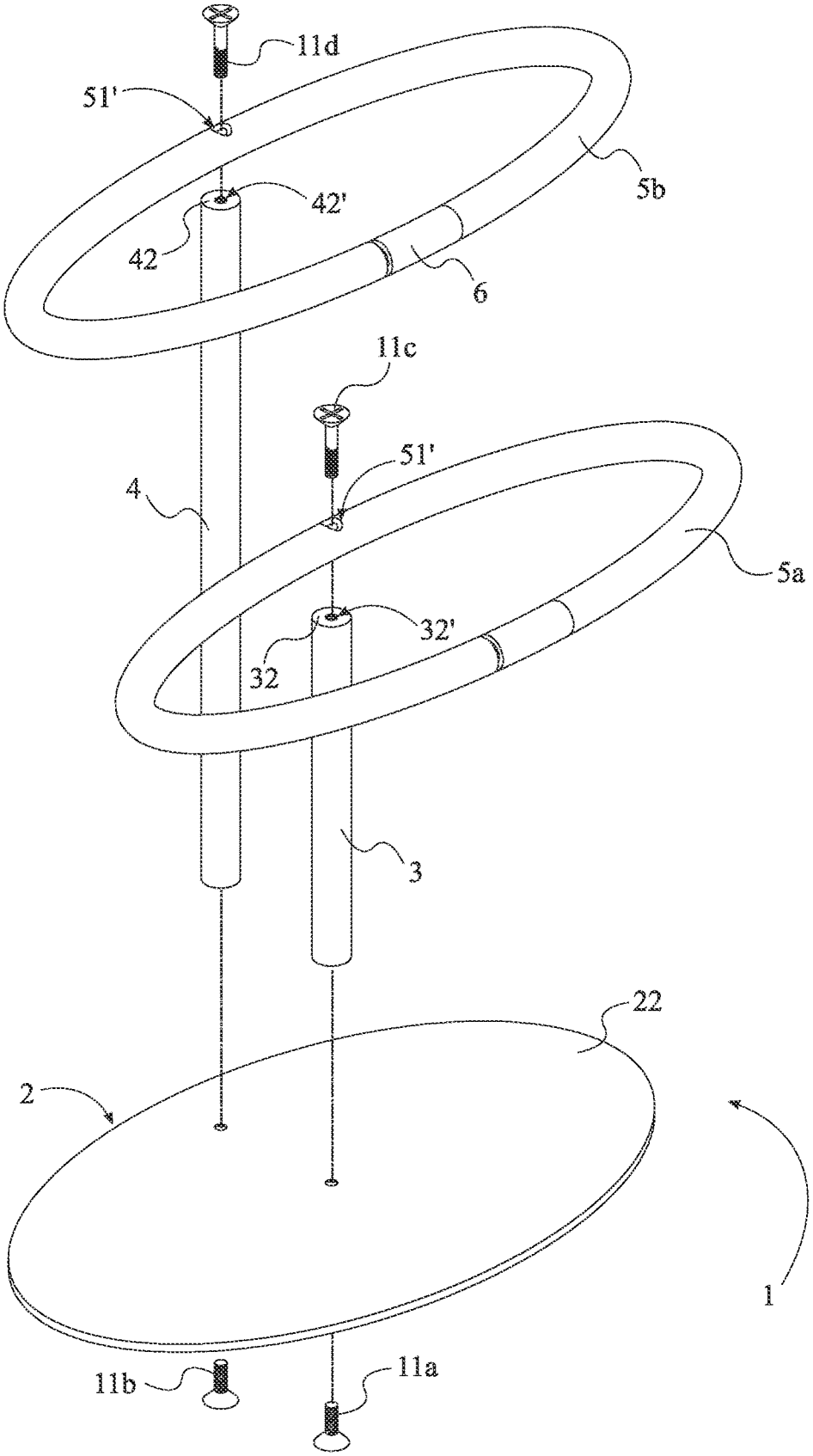
FIG. 2 is a top-front perspective exploded view of the present invention.
Figure 3:
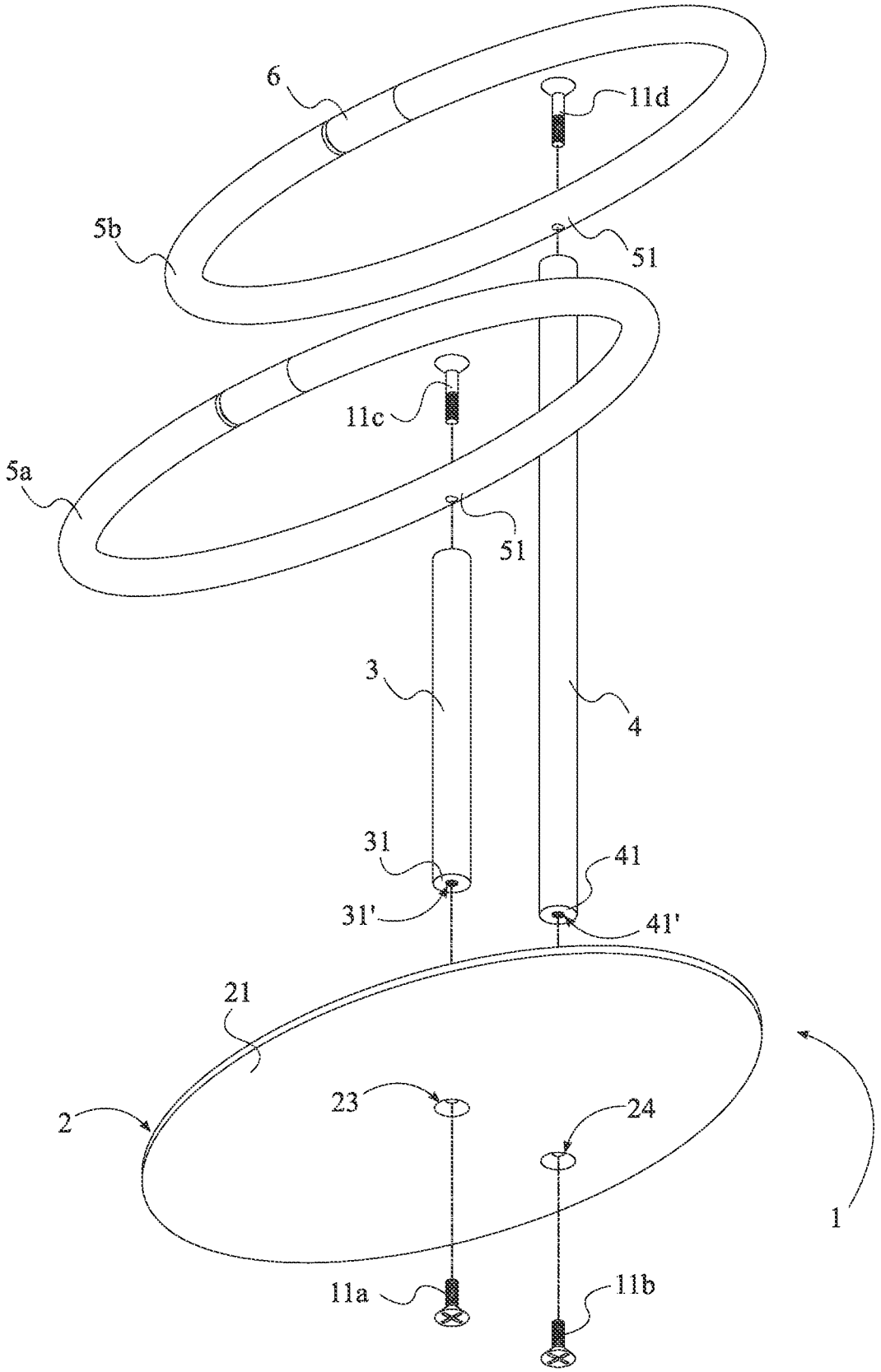
FIG. 3 is a bottom-front perspective exploded view of the present invention.

The jewelry organizer stand 1 further comprises a base 2, a first pillar 3, a second pillar 4, a first loop 5*a*, and a second loop 5*b*. As best seen in FIG. 1 through FIG. 3, the base 2 functions as the primary structural component of the present invention, as the remaining components of the present invention are configured upon the base 2. The base 2 further comprises a bottom side 21 and a top side 22. The top side 22 of the base 2 is configured to support the jewelry items, whereas the bottom side 21 is configured to sit on a surface of a countertop or any other flat surface at the user's home. The base 2, as illustrated, is oval shaped; however, other base shapes can be employed, including but not limited to circular and rectangular. As best seen in FIG. 4 through FIG. 7, the first pillar 3 is centrally connected and oriented perpendicular to the top side 22 of the base 2, extending outward to a predefined first length L1. The second pillar 4 is connected and oriented perpendicular to the top side 22 of the base 2, extending outward to a predefined second length L2. Preferably, the second pillar 4 is taller than the first pillar 3. The second pillar 4 is centrally aligned with the first pillar 3, wherein the second pillar 4 is positioned rearward of the first pillar 3 by a predefined spacing L3. Both the first pillar 3 and the second pillar 4, as illustrated, are cylindrical in shape; however, other pillar shapes can be employed, including but not limited to rectilinear. The first loop 5*a* is oriented orthogonal to the first pillar 3, wherein the mounting side 51 of the first loop 5*a* is positioned adjacent to a first top end 32 of the first pillar 3. The second loop 5*b* is oriented orthogonal to the second pillar 4, wherein the mounting side 51 of the second loop 5*b* is positioned adjacent to a second top end 42 of the second pillar 4.

In a preferred embodiment, the base 2, the first pillar 3, the second pillar 4, the first loop 5*a*, and the second loop 5*b* have holes bored therein adapted to receive a plurality of fasteners. As best seen in FIG. 2 and FIG. 3, the present invention can be configured as a packaged item comprising separate components that are later assembled by the user with fasteners. Specifically, the first pillar 3 and the second pillar 4 are removably connected to the base 2, via a first fastener 11*a* and a second fastener 11*b*, respectively. The first fastener 11*a* extends through a first aperture 23 at the bottom side 21 of the base 2 and into a threaded opening 31' at a first bottom end 31 of the first pillar 3. The second fastener 11*b* extends through a second aperture 24 at the bottom side 21 of the base 2 and into a threaded opening 41' at a second bottom end 41 of the second pillar 4. Continuing with the preferred embodiment, the first loop 5*a* is removably connected to the first pillar 3, via a third fastener 11*c*. Specifically, the third fastener 11*c* extends through an aperture 51' at the mounting side 51 of the first loop 5*a* and into a threaded opening 32' at a first top end 32 of the first pillar 3. Similarly, the second loop 5*b* is removably connected to the second pillar 4, via a fourth fastener 11*d*. Specifically, the fourth fastener 11*d* extends through an aperture 51' at the mounting side 51 of the second loop 5*b* and into a threaded opening 42' at a second top end 42 of the second pillar 4.

Figure 4:
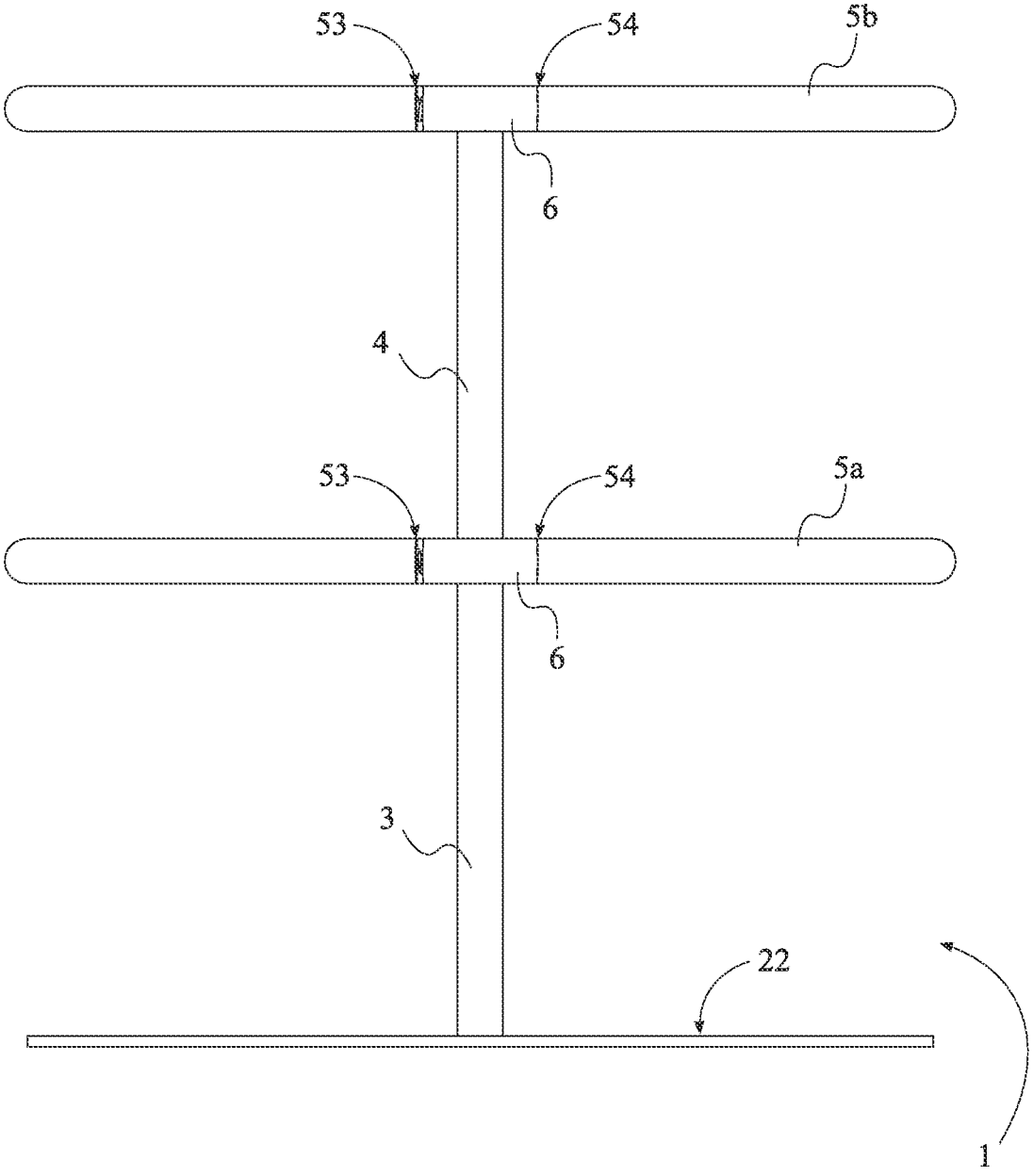
FIG. 4 is a front elevational view of the present invention.
Figure 5:
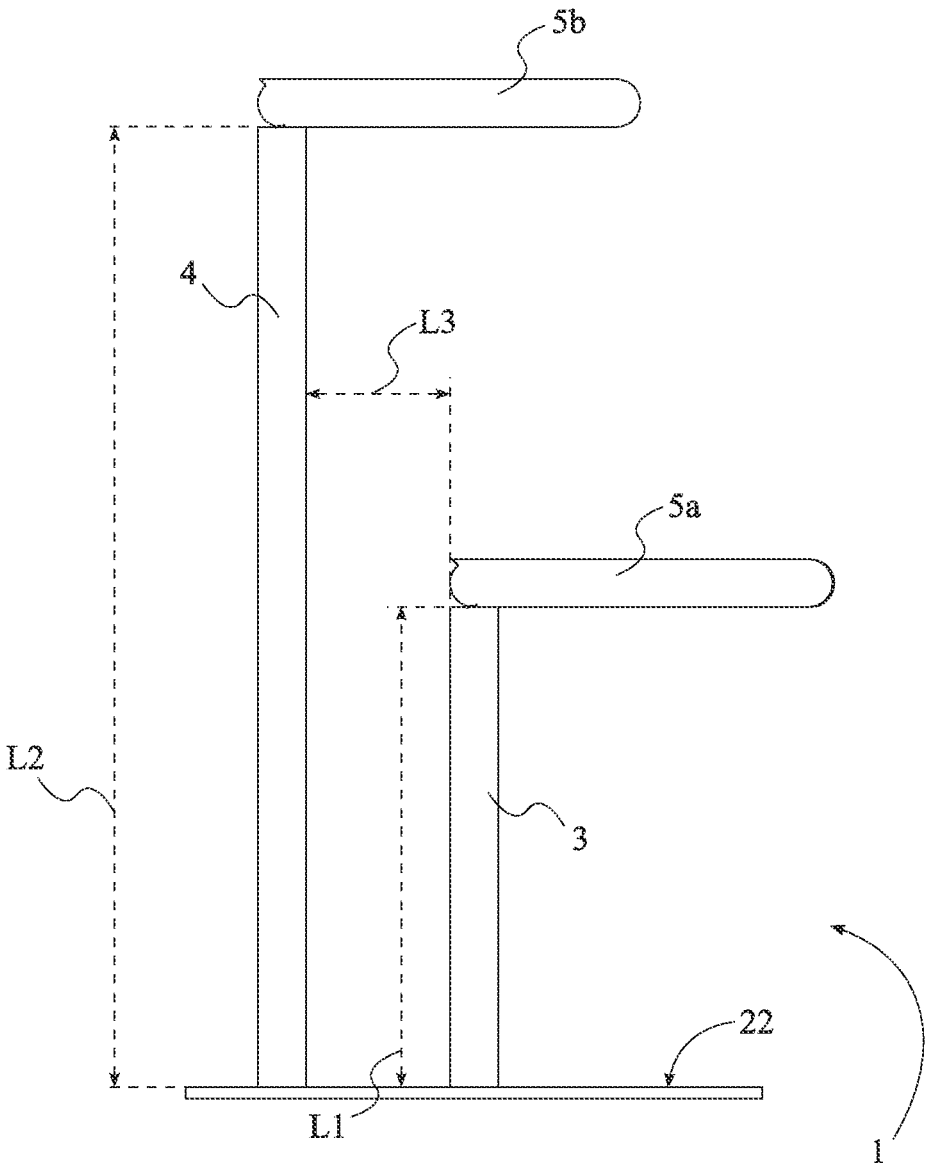
FIG. 5 is a left-side elevational view of the present invention.
Figure 6:
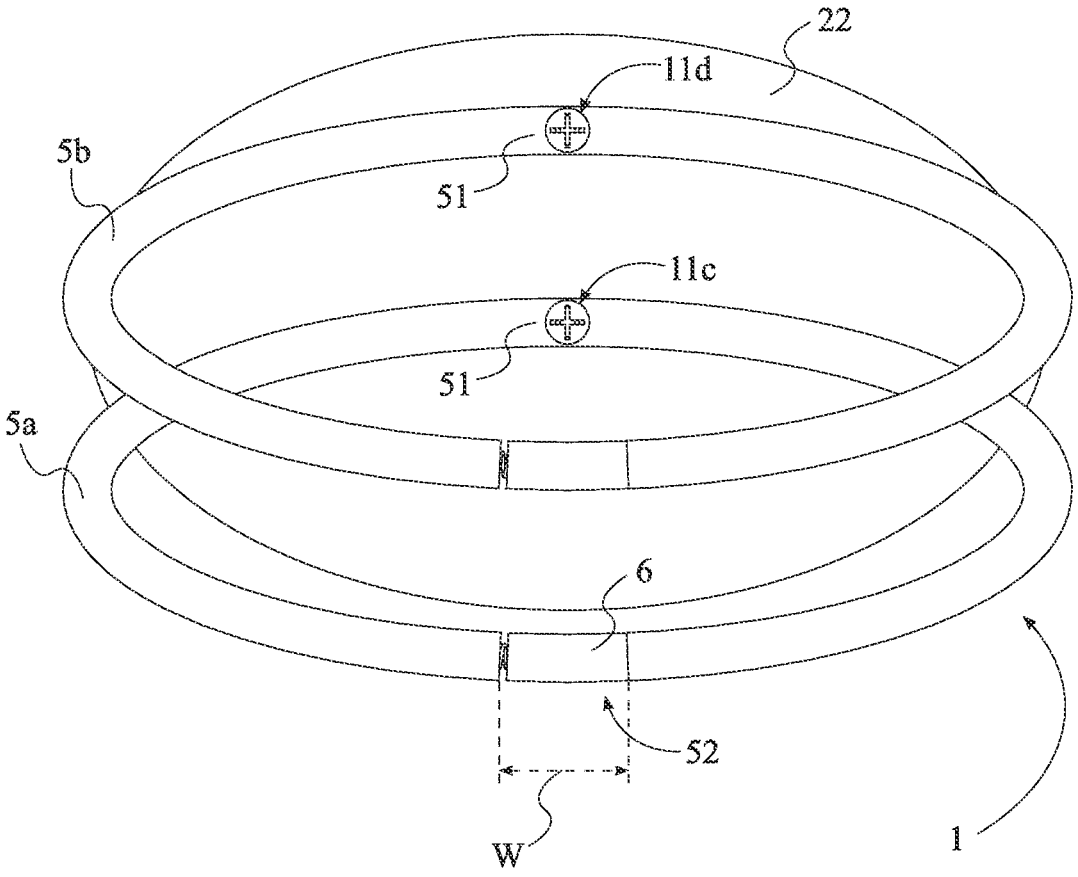
FIG. 6 is a top plan view of the present invention.
Figure 7:
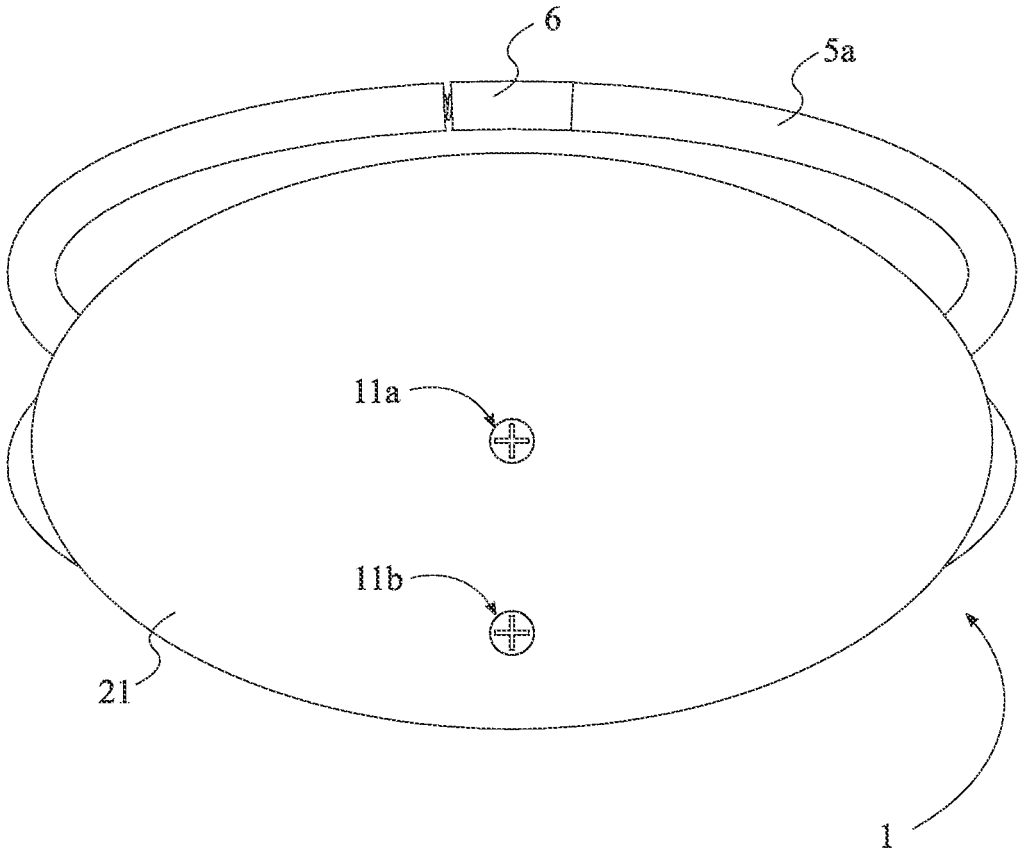
FIG. 7 is a bottom plan view of the present invention.

In the preferred embodiment, each of the first loop 5*a* and the second loop 5*b* comprises a mounting side 51, a front opening 52, a left segment end 53, a right segment end 54, a spring 7, a spring-pivot door 6, and a pair of magnets 8. As best seen in FIG. 4 and FIG. 6, each of the first loop 5*a* and the second loop 5*b* can be respectively formed as an elongated body. More specifically, each said first loop 5*a* and said second loop 5*b* has a substantially oval shape and a substantially circular cross section that is adapted to support various pieces of jewelry, including but not limited to bracelets and necklaces. Other types of shapes can be used, including but not limited to circular and rectilinear. In addition, other types of cross-sections can be used, including but not limited to oval and rectilinear. On each of the first loop 5*a* and the second loop 5*b*, the front opening 52 is positioned opposite of the mounting side 51. The formation of the front opening 52 separates the left segment end 53 from the right segment end 54. Moreover, the front opening 52 has a predefined width W separating the left segment end 53 from the right segment end 54.

Figure 8:
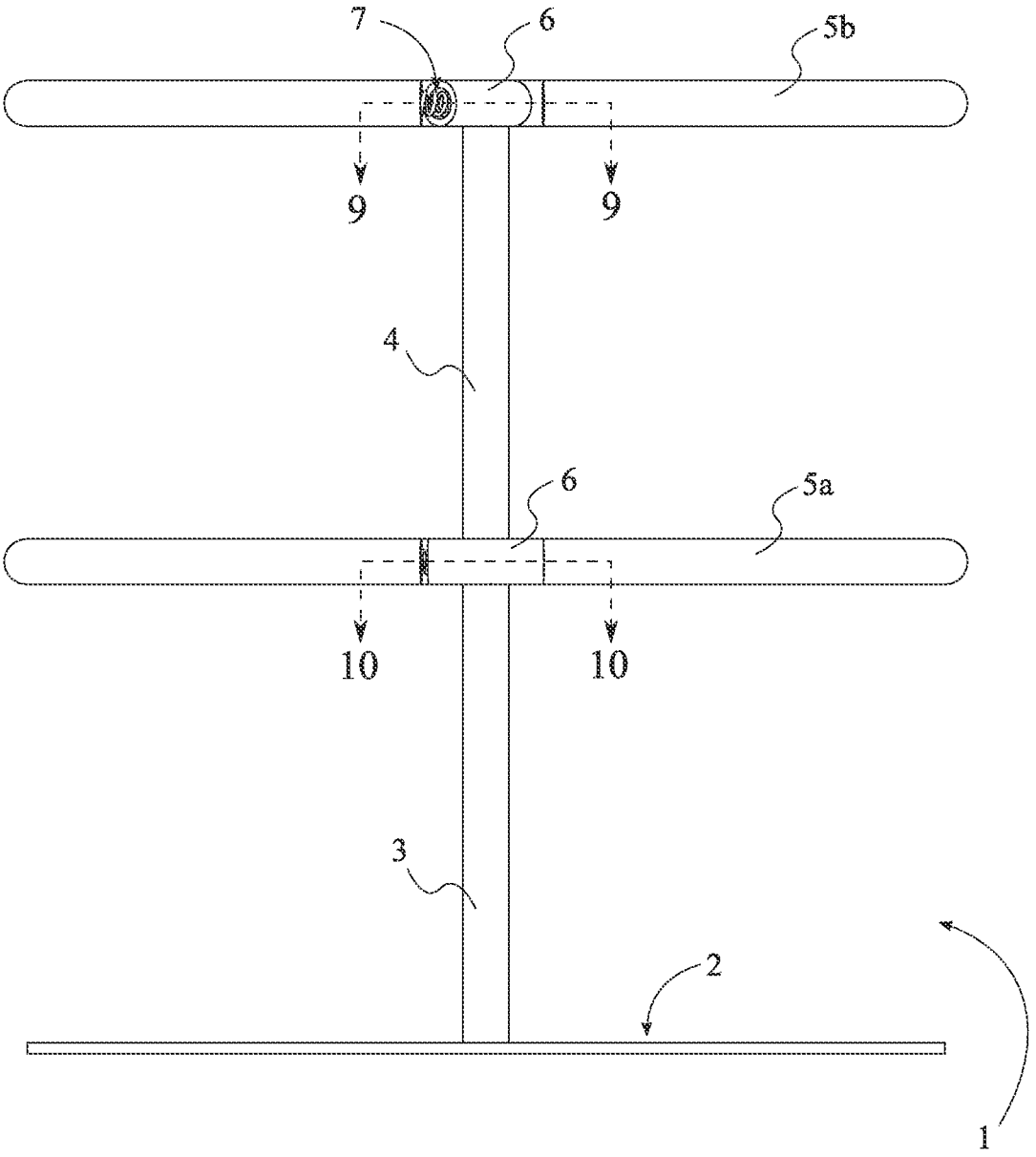
FIG. 8 is a front elevational view of the present invention, showing the second loop in an open/unlocked configuration.
Figure 9:
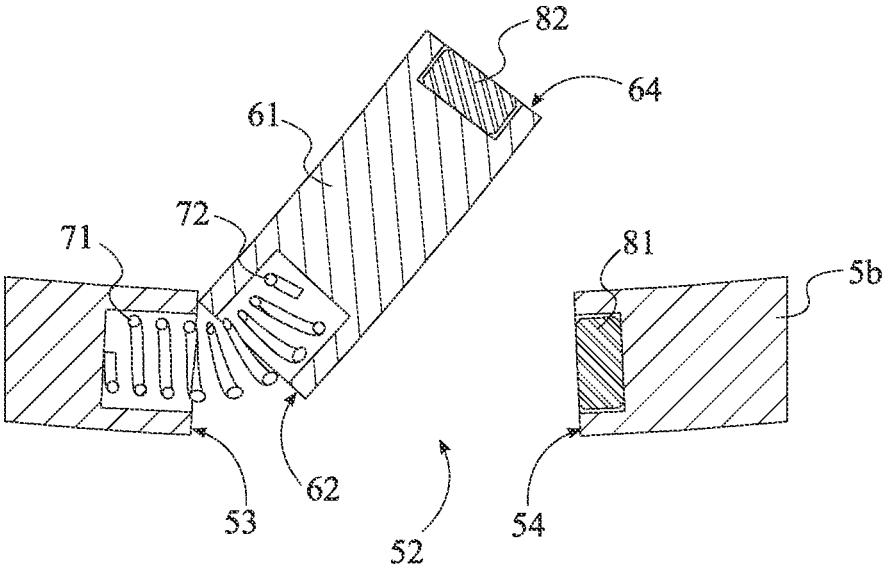
FIG. 9 is an enlarged, cross-sectional view taken along line 9-9 in FIG. 8.
Figure 10:
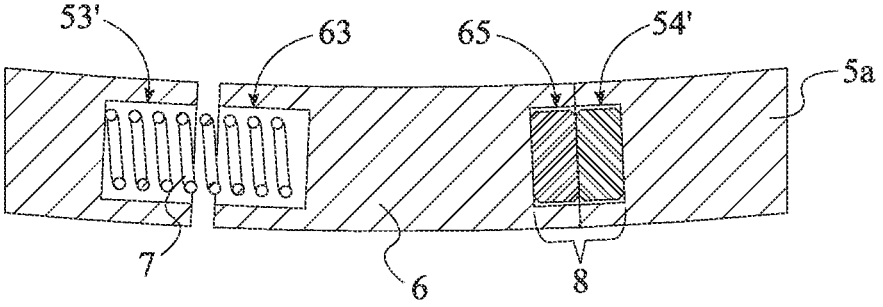
FIG. 10 is an enlarged, cross-sectional view taken along line 10-10 in FIG. 8.
Figure 11:
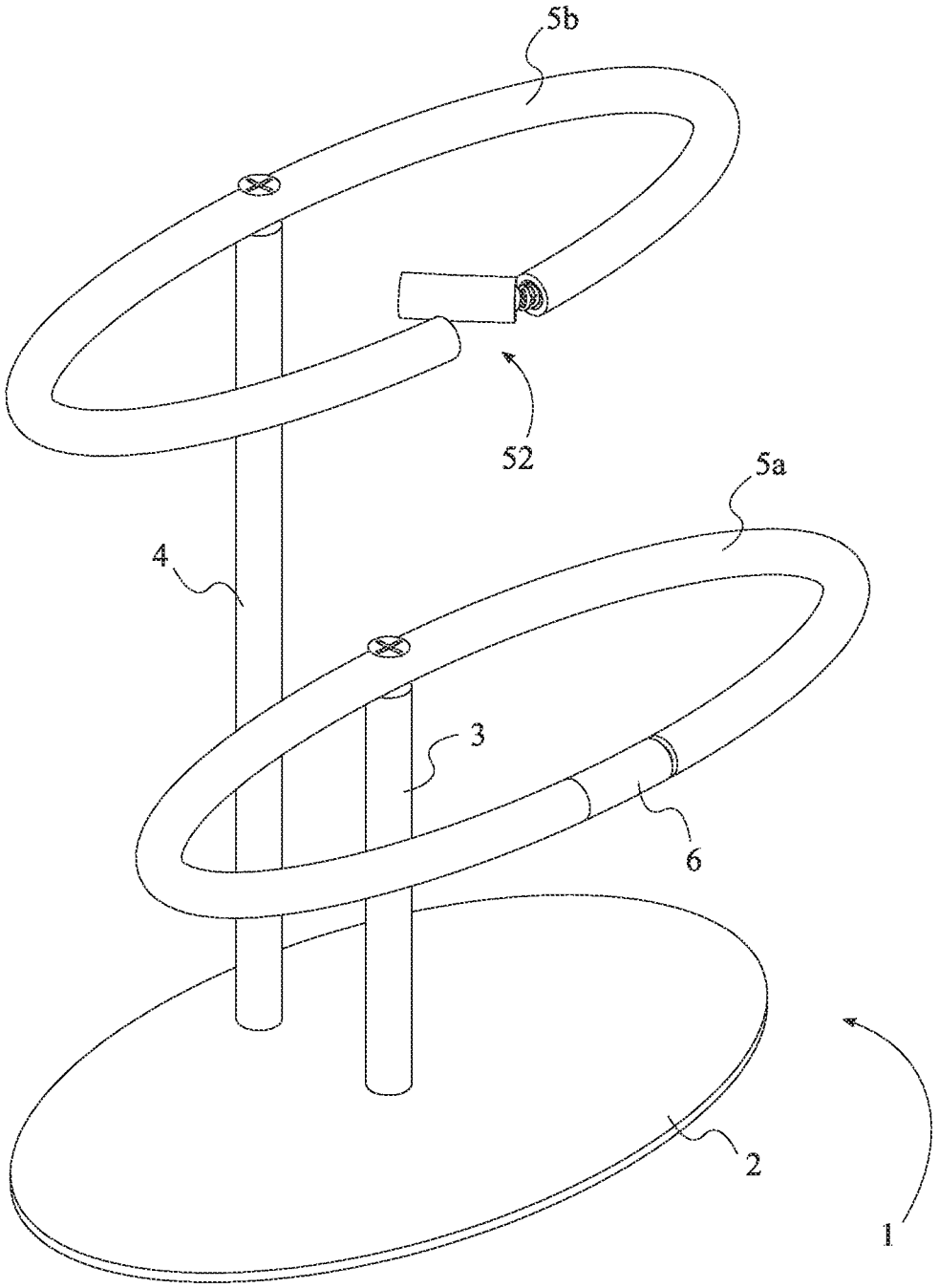
FIG. 11 is a top-front perspective view of the present invention in accordance with another embodiment.
Figure 12:
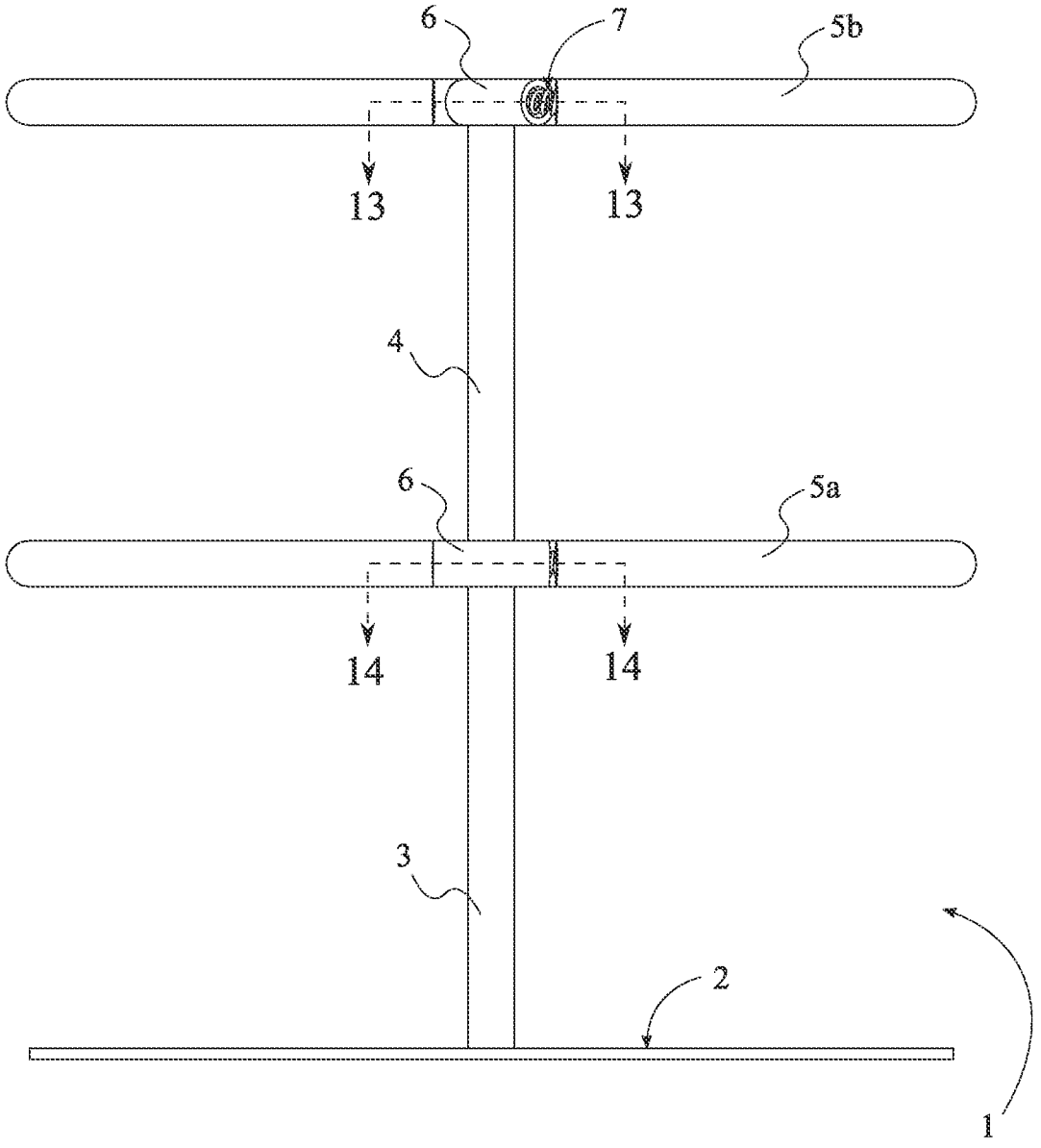
FIG. 12 is a front elevational view of the present invention in accordance with another embodiment.
Figure 13:
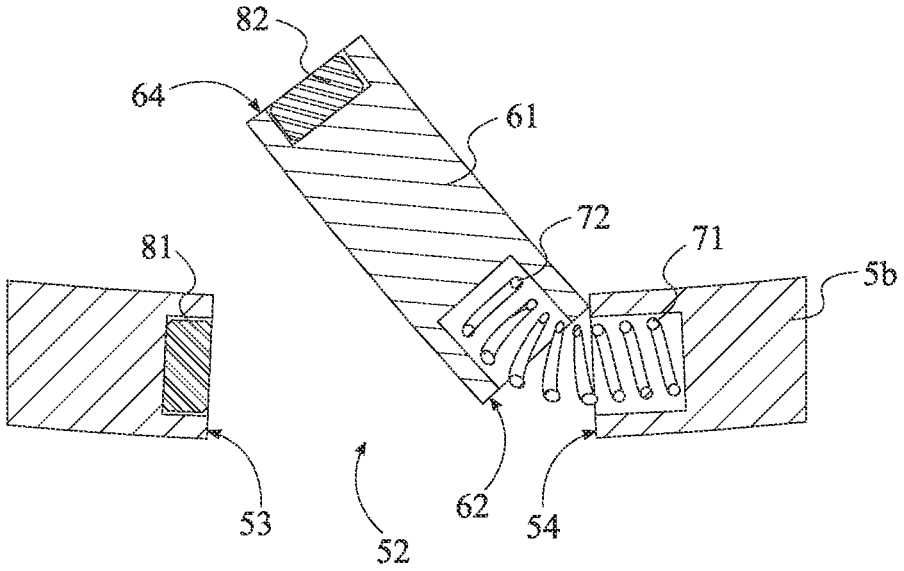
FIG. 13 is an enlarged, cross-sectional view taken along line 13-13 in FIG. 12.
Figure 14:
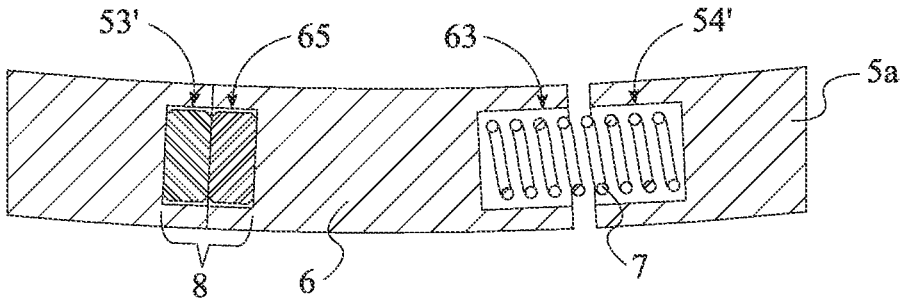
FIG. 14 is an enlarged, cross-sectional view taken along line 14-14 in FIG. 12.
Figure 15:
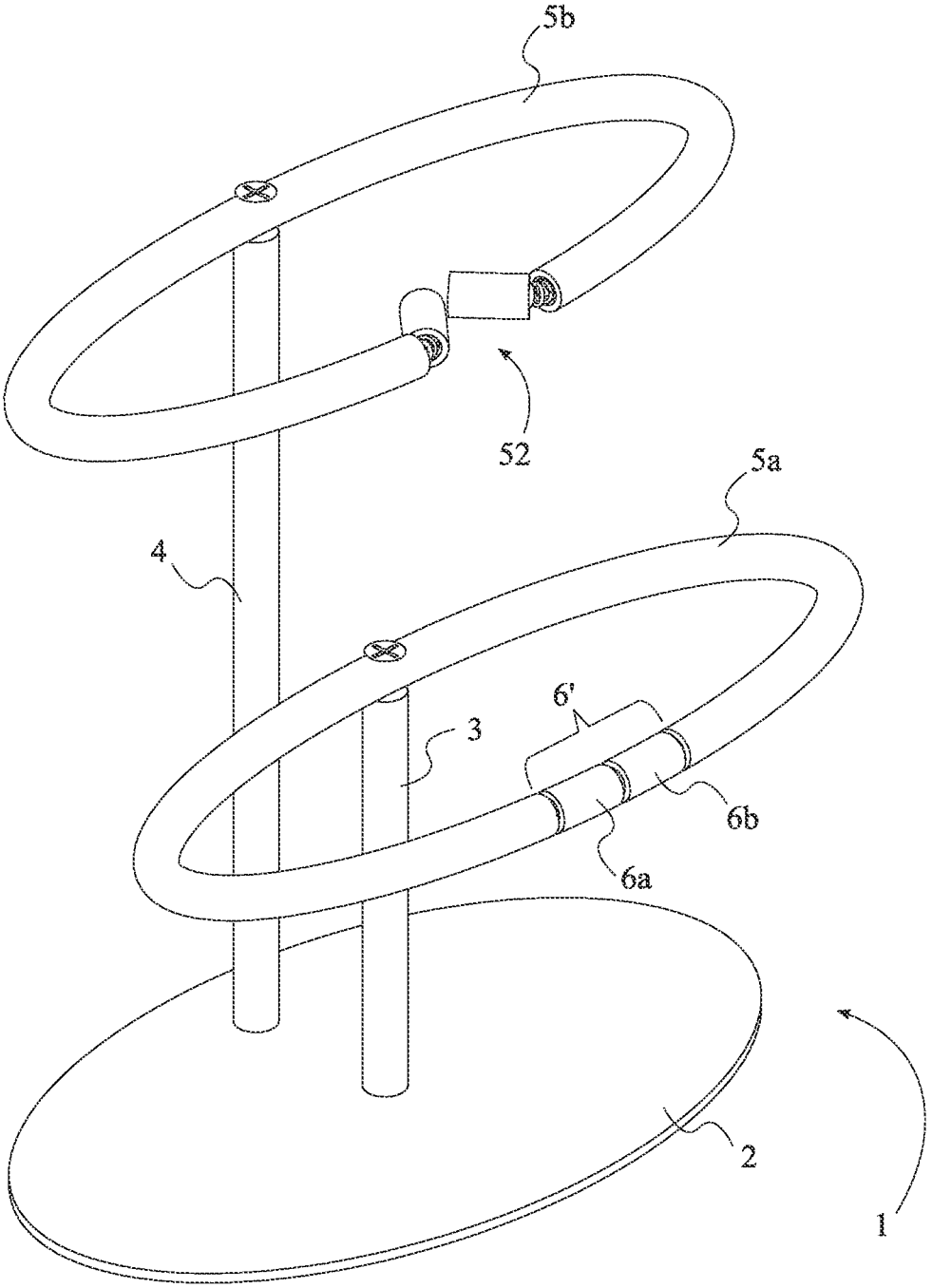
FIG. 15 is a top-front perspective view of the present invention in accordance with another embodiment.
Figure 16:
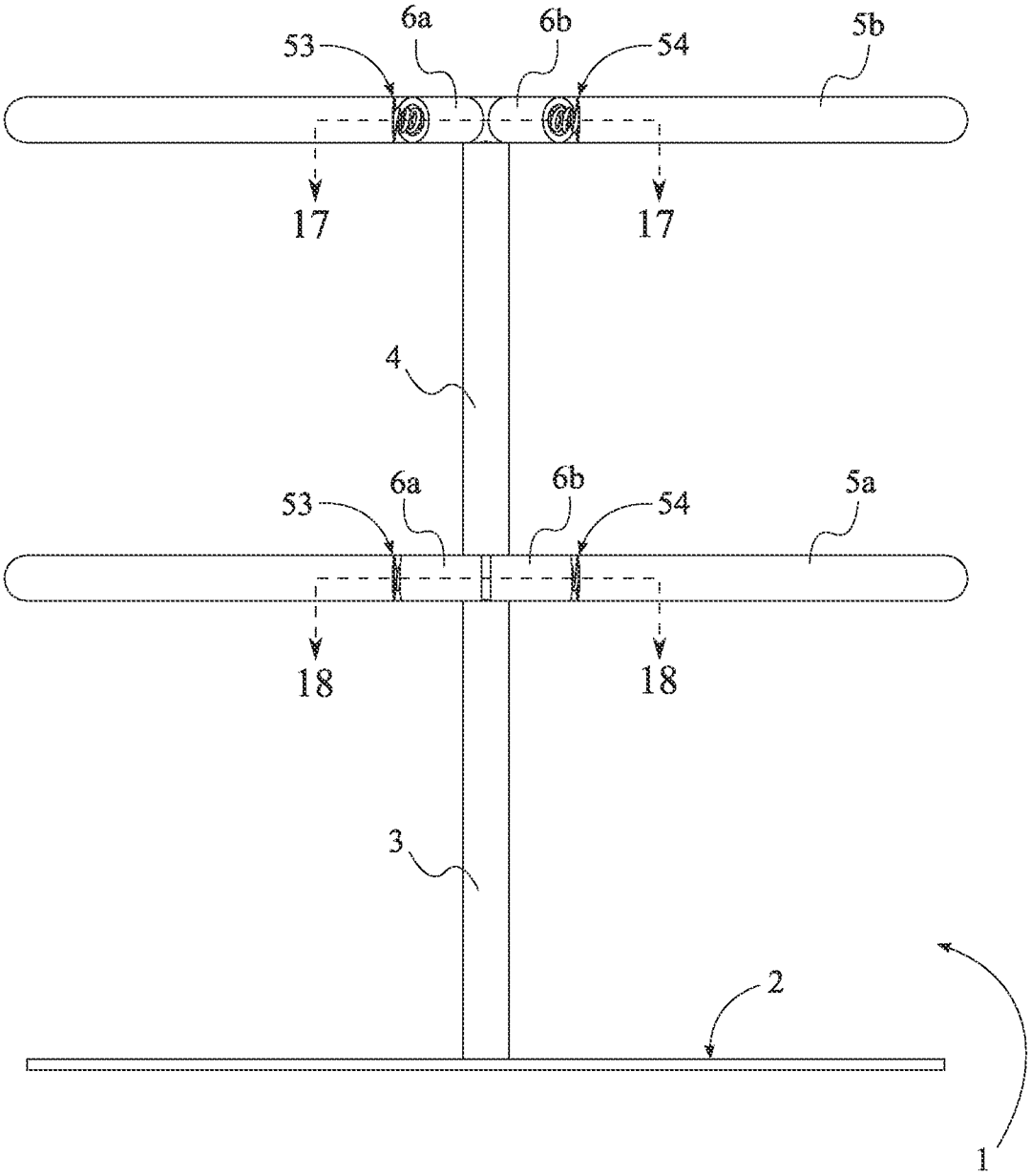
FIG. 16 is a front elevational view of the present invention in accordance with another embodiment.

In reference to FIG. 8 through FIG. 10, the spring-pivot door 6 is positioned within the front opening 52 and pivotally connected to the left segment end 53, via the spring 7. The pair of magnets 8 help secure the spring-pivot door 6 in place when the spring-pivot door 6 is in a closed position. The spring-pivot door 6 further comprises an elongated body 61, a mounting end 62, and a free end 64. The elongated body 61 has substantially the same arc as the first loop 5*a* and the second loop 5*b*, such that the elongated body 61 surrounds the front opening 52.

Continuing with the preferred embodiment, in order to pivotally connect the spring-pivot door 6 to the left segment end 53, both the left segment end 53 and the spring-pivot door 6 are adapted to fit the spring 7. More specifically, the left segment end 53 has a recess 53' to fit a first end 71 of the spring 7. Similarly, the mounting end 62 of the spring-pivot door 6 has a recess 63 to fit a second end 72 of the spring 7. In this arrangement, the first end 71 of the spring 7 is fixedly attached to the left segment end 53, whereas the second end 72 of the spring 7 is fixedly attached to the mounting end 62 of the spring-pivot door 6. The spring 7 can be fixedly attached by any suitable means, such as, but not limited to adhesive bonding and press fit.

Continuing with the preferred embodiment, in order to magnetically secure the spring-pivot door 6 in a closed position, both the right segment end 54 and the spring-pivot door 6 are adapted to fit the pair of magnets 8. In this embodiment, the pair of magnets 8 further comprise a first magnet 81 and a second magnet 82. The right segment end 54 has a recess 54' to fit the first magnet 81. Similarly, the free end 64 of the spring-pivot door 6 has a recess 65 to fit the second magnet 82. In this arrangement, the first magnet 81 is fixedly attached to the right segment end 54, and the second magnet 82 is fixedly attached to the free end 64 of the spring-pivot door 6. The pair of magnets 8 can be fixedly attached by any suitable means, such as, but not limited to adhesive bonding and press fit.

In a second embodiment, the spring-pivot door 6 can be configured to open from the other side. As seen in FIG. 11 through FIG. 14, the spring-pivot door 6 can be configured to pivotally connect to the right segment end 54 and magnetically secure to the left segment end 53. In this embodiment, the right segment end 54 is adapted to fit the first end 71 of the spring 7, whereas the left segment end 53 is adapted to fit the first magnet 81. Thus, the first end 71 of the spring 7 is fixedly attached to the right segment end 54, and the first magnet 81 is fixedly attached to the left segment end 53.

Figure 17:
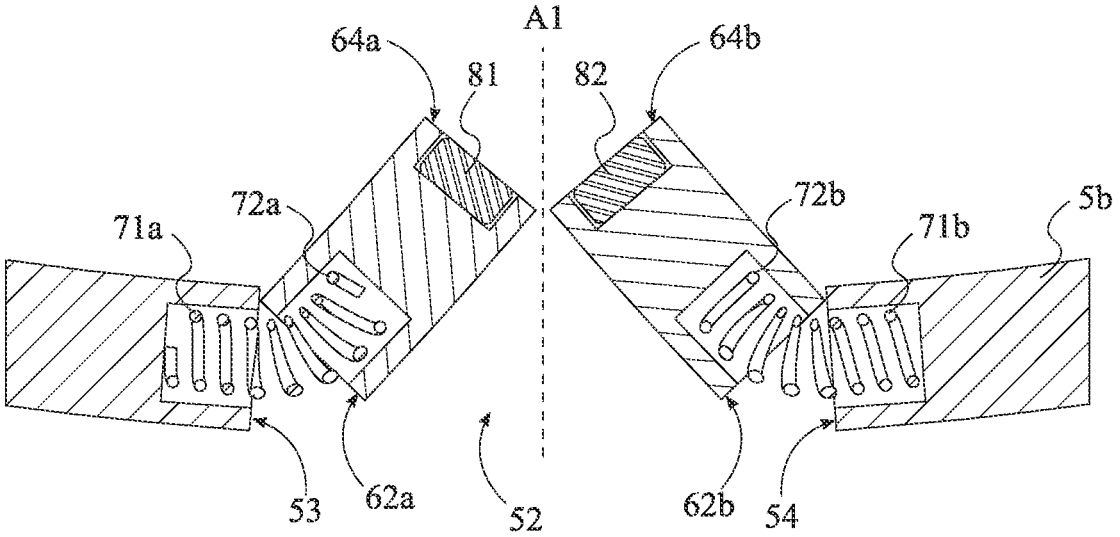
FIG. 17 is an enlarged, cross-sectional view taken along line 17-17 in FIG. 16.
Figure 18:
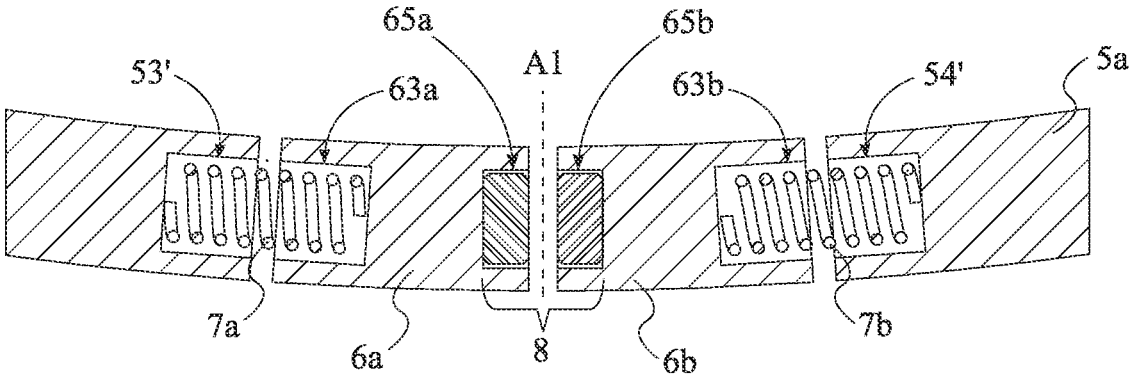
FIG. 18 is an enlarged, cross-sectional view taken along line 18-18 in FIG. 16.

In a third embodiment, each of the first loop 5*a* and the second loop 5*b* comprises a pair of spring-pivot doors 6', a left spring 7*a*, and a right spring 7*b*. In reference to FIG. 15 through FIG. 18, the pair of spring-pivot doors 6' are opposingly aligned and open along a center axis A1 of the front opening 52. The pair of spring-pivot doors 6' pivotally connect to the left segment end 53 and the right segment end 54, via the left spring 7*a* and the right spring 7*b*, respectively. Thus, the pair of spring-pivot doors 6' function independently as bi-fold swing doors (e.g., saloon-style doors). As best seen in FIG. 17 and FIG. 18, the pair of spring-pivot doors 6' comprise a left spring-pivot door 6*a* and a right spring-pivot door 6*b*. Starting with the left-hand side, a first end 71*a* of the left spring 7*a* is fixedly attached to the left segment end 53. A second end 72*a* of the left spring 7*a* is fixedly attached to a mounting end 62*a* of the left spring-pivot door 6*a*. Both the left segment end 53 and the mounting end 62*a* of the left spring-pivot door 6*a* are adapted to fit the left spring 7*a*. More specifically, the left segment end 53 has a recess 53' to fit the first end 71*a* of the left spring 7*a*. Similarly, the mounting end 62*a* of the left spring-pivot door 6*a* has a recess 63*a* to fit the second end 72*a* of the left spring 7*a*. On the right-hand side, a first end 71*b* of the right spring 7*b* is fixedly attached to the right segment end 54. A second end 72*b* of the right spring 7*b* is fixedly attached to a mounting end 62*b* of the right spring-pivot door 6*b*. Both the right segment end 54 and the mounting end 62*b* of the right spring-pivot door 6*b* are adapted to fit the right spring 7*b*. More specifically, the right segment end 54 has a recess 54' to fit the first end 71*b* of the right spring 7*b*. Similarly, the mounting end 62*b* of the right spring-pivot door 6*b* has a recess 63*b* to fit the second end 72*b* of the right spring 7*b*.

Continuing with this embodiment, in order to magnetically secure the pair of spring-pivot doors 6' in a closed position, both free ends on the pair of spring-pivot doors 6' are adapted to fit the pair of magnets 8. In this embodiment, the free end 64*a* of the left spring-pivot door 6*a* has a recess 65*a* to fit the first magnet 81. Similarly, the free end 64*b* of the right spring-pivot door 6*b* has a recess 65*b* to fit the second magnet 82. In this arrangement, the first magnet 81 is fixedly attached to the free end 64*a* of the left swing-pivot door 6*a*, whereas the second magnet 82 is fixedly attached to the free end 64*b* of the right spring-pivot door 6*b*. The pair of magnets 8 can be fixedly attached by any suitable means, such as, but not limited to adhesive bonding and press fit.

Figure 19:
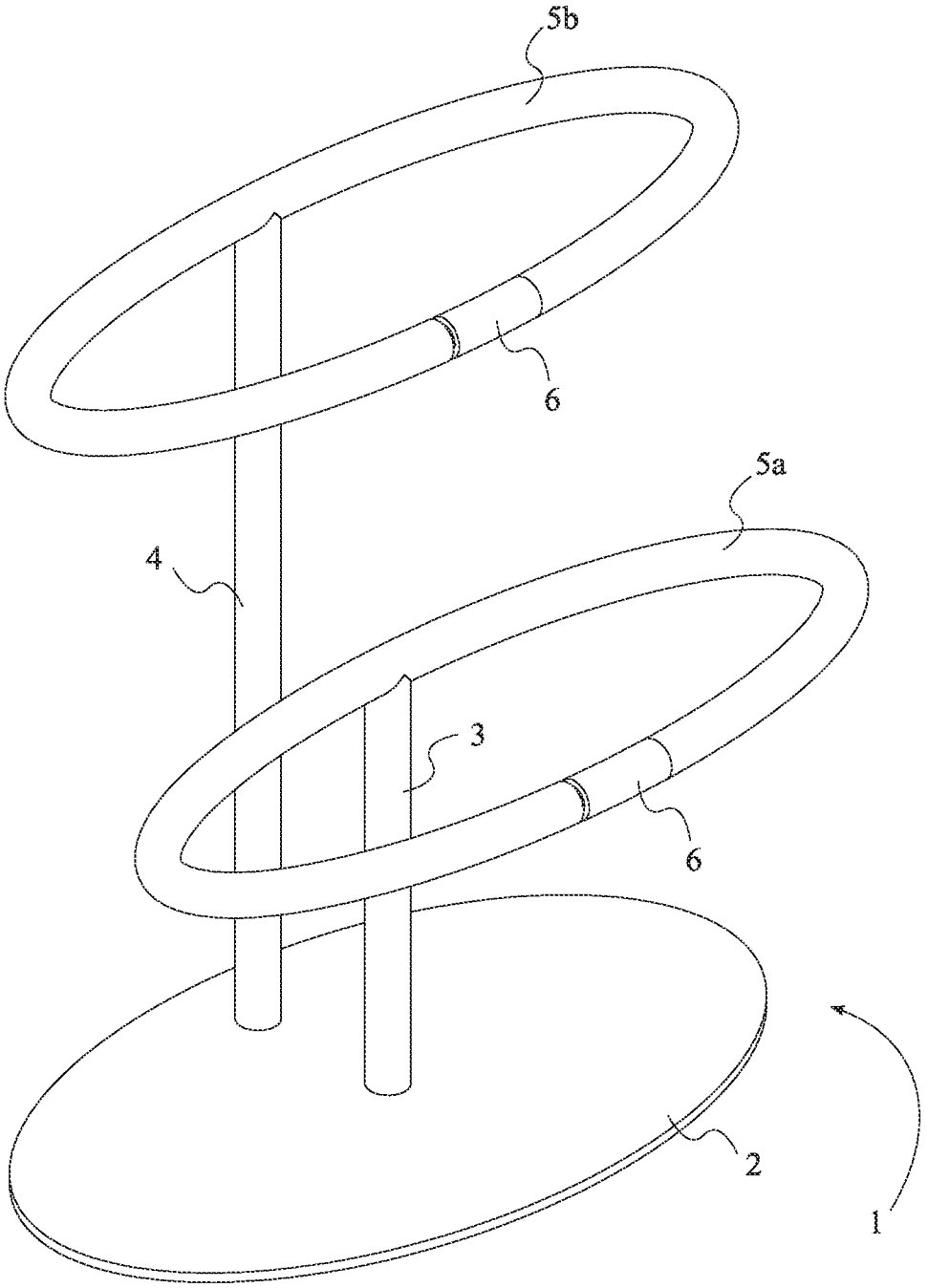
FIG. 19 is a top-front perspective view of the present invention in accordance with another embodiment.

In a fourth embodiment, the base 2, the first pillar 3, the second pillar 4, the first loop 5*a*, and the second loop 5*b* are all terminally connected to form a single piece, as seen in FIG. 19. More specifically, the first bottom end 31 of the first pillar 3 is terminally connected to the top side 22 of the base 2. The second bottom end 41 of the second pillar 4 is terminally connected to the top side 22 of the base 2. The mounting side 51 of the first loop 5*a* is terminally connected to the first top end 32 of the first pillar 3. The mounting side 51 of the second loop 5*b* is terminally connected to the second top end 42 of the second pillar 4.

Figure 20:
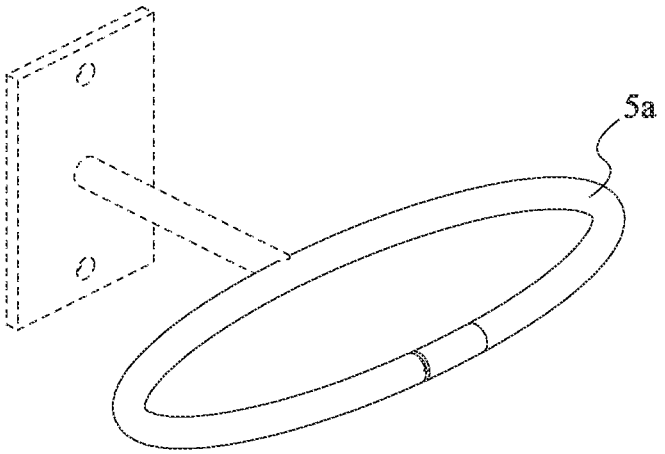
FIG. 20 is a top-front perspective view of the present invention in accordance with another embodiment.
Figure 21:
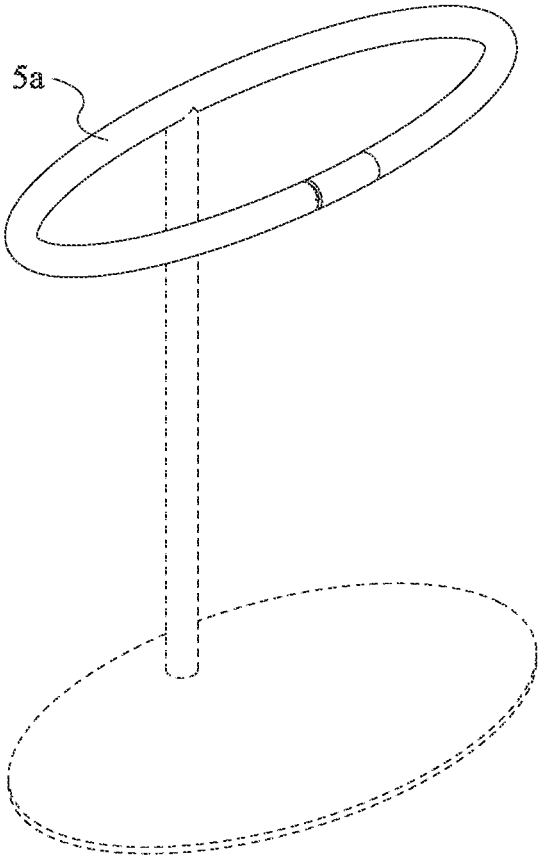
FIG. 21 is a top-front perspective view of the present invention in accordance with another embodiment.

In a fifth embodiment, the present invention comprises a first loop 5*a*. As illustrated in FIG. 20 and FIG. 21, the mounting side 51 of the first loop 5*a* can be fixedly attached to any mounting structure including, but not limited to a desk stand, a wall plate, a mirror using suction cups, or a slat-wall bracket.

Although the invention has been explained in relation to its preferred embodiment, it is to be understood that many other possible modifications and variations can be made without departing from the spirit and scope of the invention.

What is claimed is:

1. A display stand comprising:

a first loop;

the first loop comprising a mounting side, a front opening, a left segment end, a right segment end, a spring, a pair of magnets, and a spring-pivot door;

the front opening being positioned opposite of the mounting side;

the spring-pivot door surrounding the front opening;

the spring-pivot door being pivotally connected to the left segment end, via the spring;

the left segment end adapted to receive a first end of the spring;

a mounting end of the spring-pivot door adapted to receive a second end of the spring;

the pair of magnets comprising a first magnet and a second magnet;

the right segment end being adapted to receive the first magnet;

a free end of the spring-pivot door adapted to receive the second magnet;

the spring-pivot door having an open position for insertion/removal of items to/from the left segment end and the right segment end;

the spring-pivot door having a closed position enabling sliding movement of items between the left segment end and the right segment end; and the pair of magnets enabling the spring-pivot door to effectively lock in the closed position.

2. The display stand as claimed in claim 1 comprising:

a second loop, a base, a first pillar, and a second pillar;

the second loop being identical to the first loop;

the base having a top side and a bottom side;

the first pillar having a first bottom end and a first top end;

the second pillar having a second bottom end and a second top end;

the first bottom end being centrally disposed on the top side of the base;

the second bottom end being disposed on the top side of the base;

the mounting side of the first loop being connected to the first top end; and the mounting side of the second loop being connected to the second top end.

3. The display stand as claimed in claim 2 comprising:

a first fastener removably attaching the first pillar to the base;

a second fastener removably attaching the second pillar to the base;

a third fastener removably attaching the first loop to the first pillar; and a fourth fastener removably attaching the second loop to the second pillar.

4. The display stand as claimed in claim 2 comprising:

the first pillar being terminally connected to the base;

the second pillar being terminally connected to the base;

the first loop being terminally connected to the first pillar; and the second loop being terminally connected to the second pillar.

5. The display stand as claimed in claim 2 comprising:

the first pillar having a first length;

the second pillar having a second length; and the second length being greater than the first length.

6. The display stand as claimed in claim 5 comprising:

the second pillar being centrally aligned with the first pillar; and the second pillar being positioned rearward of the first pillar, delineated by a predefined spacing.

7. The display stand as claimed in claim 1 comprising:

the first loop having a substantially oval shape.

8. A display stand comprising:

a base having a top side and a bottom side;

a first pillar having a first bottom end and a first top end;

a second pillar having a second bottom end and a second top end;

a first loop;

a second loop;

the first bottom end being centrally disposed on the top side of the base;

the second bottom end being disposed on the top side of the base;

each of the first loop and the second loop comprising a mounting side, a front opening, a left segment end, a right segment end, a spring, and a spring-pivot door;

the mounting side of the first loop being connected to the first top end;

the mounting side of the second loop being connected to the second top end;

the front opening being positioned opposite of the mounting side;

the spring-pivot door surrounding the front opening;

the spring-pivot door being pivotally connected to the left segment end, via the spring;

the left segment end adapted to receive a first end of the spring;

a mounting end of the spring-pivot door adapted to receive a second end of the spring;

the spring-pivot door having an open position for insertion/removal of items to/from the left segment end and the right segment end; and the spring-pivot door having a closed position enabling sliding movement of items between the left segment end and the right segment end.

9. The display stand as claimed in claim 8 comprising:

each of the first loop and the second loop further comprising a pair of magnets;

the pair of magnets comprising a first magnet and a second magnet;

the right segment end being adapted to receive the first magnet;

a free end of the spring-pivot door adapted to receive the second magnet; and the pair of magnets enabling the spring-pivot door to effectively lock in the closed position.

10. The display stand as claimed in claim 8 comprising:

a first fastener removably attaching the first pillar to the base;

a second fastener removably attaching the second pillar to the base;

a third fastener removably attaching the first loop to the first pillar; and a fourth fastener removably attaching the second loop to the second pillar.

11. The display stand as claimed in claim 8 comprising:

the first pillar being terminally connected to the base;

the second pillar being terminally connected to the base;

the first loop being terminally connected to the first pillar; and the second loop being terminally connected to the second pillar.

12. The display stand as claimed in claim 8 comprising:

the first pillar having a first length;

the second pillar having a second length; and the second length being greater than the first length.

13. The display stand as claimed in claim 12 comprising:

the second pillar being centrally aligned with the first pillar; and the second pillar being positioned rearward of the first pillar, delineated by a predefined spacing.

14. The display stand as claimed in claim 8 comprising:

the first loop having a substantially oval shape; and the second loop having a substantially oval shape.

15. A display stand comprising:

a first loop having a substantially oval shape;

the first loop comprising a mounting side, a front opening, a left segment end, a right segment end, a left spring, a right spring, a pair of magnets, and a pair of spring-pivot doors;

the front opening being positioned opposite of the mounting side;

the pair of spring-pivot doors surrounding the front opening;

the pair of spring-pivot doors further comprising a left spring-pivot door and a right spring-pivot door;

the left spring-pivot door being pivotally connected to the left segment end, via the left spring;

the left segment end adapted to receive a first end of the left spring;

a mounting end of the left spring-pivot door adapted to receive a second end of the left spring;

the right spring-pivot door being pivotally connected to the right segment end, via the right spring;

the right segment end adapted to receive a first end of the right spring;

a mounting end of the right spring-pivot door adapted to receive a second end of the right spring;

the pair of magnets comprising a first magnet and a second magnet;

a free end of the left spring-pivot door adapted to receive the first magnet;

a free end of the right spring-pivot door adapted to receive the second magnet;

the pair of spring-pivot doors having an open position for insertion/removal of items to/from the left segment end and the right segment end;

the pair of spring-pivot doors having a closed position enabling sliding movement of items between the left segment end and the right segment end; and the pair of magnets enabling the pair of spring-pivot doors to effectively lock in the closed position.

16. The display stand as claimed in claim 15 comprising:

a second loop, a base, a first pillar, and a second pillar;

the second loop being identical to the first loop;

the base having a top side and a bottom side;

the first pillar having a first bottom end and a first top end;

the second pillar having a second bottom end and a second top end;

the first bottom end being centrally disposed on the top side of the base;

the second bottom end being disposed on the top side of the base;

the mounting side of the first loop being connected to the first top end; and the mounting side of the second loop being connected to the second top end.

17. The display stand as claimed in claim 16 comprising:

a first fastener removably attaching the first pillar to the base;

a second fastener removably attaching the second pillar to the base;

a third fastener removably attaching the first loop to the first pillar; and a fourth fastener removably attaching the second loop to the second pillar.

18. The display stand as claimed in claim 16 comprising:

the first pillar being terminally connected to the base;

the second pillar being terminally connected to the base;

the first loop being terminally connected to the first pillar; and the second loop being terminally connected to the second pillar.

19. The display stand as claimed in claim 16 comprising:

the first pillar having a first length;

the second pillar having a second length; and the second length being greater than the first length.

20. The display stand as claimed in claim 19 comprising:

the second pillar being centrally aligned with the first pillar; and the second pillar being positioned rearward of the first pillar, delineated by a predefined spacing.

* * * * *